United States Patent [19]

Paul et al.

[11] Patent Number: 4,789,360

[45] Date of Patent: Dec. 6, 1988

[54] ELECTRICAL CONNECTOR WITH REAR REMOVABLE CONTACTS

[75] Inventors: Richard L. Paul; Ronald W. Morse, both of Sidney, N.Y.

[73] Assignee: Amphenol Corporation, Wallingford, Conn.

[21] Appl. No.: 153,731

[22] Filed: Jan. 19, 1988

Related U.S. Application Data

[63] Continuation of Ser. No. 926,479, Nov. 3, 1986, abandoned.

[51] Int. Cl.[4] ..... H01R 13/66

[52] U.S. Cl. ..... 439/620

[58] Field of Search ..... 339/143 R, 147 R, 147 P, 339/89 R, 89 M, 94 M; 333/131-184; 439/312-323, 607-610, 620

[56] References Cited

U.S. PATENT DOCUMENTS

| | | | |
|---|---|---|---|
| 3,078,436 | 2/1963 | Berry | 339/143 R |
| 4,023,881 | 5/1977 | Migneau | 339/74 R |
| 4,029,386 | 6/1977 | Krantz, Jr. et al. | 339/143 R |
| 4,262,268 | 4/1981 | Shimada et al. | 339/182 |
| 4,477,022 | 10/1984 | Shuey et al. | 339/89 M |
| 4,494,092 | 1/1985 | Griffin | 339/147 R |
| 4,600,262 | 7/1986 | Nieman et al. | 339/182 |

*Primary Examiner*—John McQuade

*Attorney, Agent, or Firm*—Bacon & Thomas

[57] ABSTRACT

A connector assembly allows rear repair/replacement of first contacts so that circuit protection elements may be checked for damage or replaced. A pair of inserts each having a like array of passages extending between its end faces are disposed in a connector shell one insert being fixed and adapted to receive the first contacts and the other insert being removable and carrying in its passages a second contact to mate with a first contact. The first contact carries the circuit protection element and is removably mounted in the shell with one end thereof for mating with a second contact. Means including a coupling nut removably secure the removable insert to a rearward end portion of the shell. Means including a key/keyway on the shell/removable insert align the inserts so that each array of passages is aligned with one another.

5 Claims, 1 Drawing Sheet

ELECTRICAL CONNECTOR WITH REAR REMOVABLE CONTACTS

This application is a continuation of application Ser. No. 926,479, filed Nov. 3, 1986, now abandoned.

This invention relates to an electrical connector with rear removable contacts.

In some applications electrical circuits need protection from transient signals such as electromagnetic pulses, lightning, and other voltages having pulses of extemely short duration and high amplitudes. Silicon diodes and metal oxide varistors provide such circuit protection to signals and recently they have been incorporated on associated contacts of matable connectors. Typically these circuit protected contacts were premanently encapsulated within the connector shell. While suitable for many users, if one circuit were to become defective it was necessary to replace the entire connector. Accordingly a need arises for circuit protected contacts to be removed from its connector either to repair the contact or possibly to change the protection provided to that circuit.

When installed in the field, the mated end portions of shells are oftentimes lockwired together and the only access to the user is from the rear of the shell. Accordingly a connector assembly would include circuit protected contacts which are rear releasable from their shell.

An electrical connector assembly includes a hollow cylindrical metal shell, a dielectric insert having an array of passages extending between its faces and receiving a first contact in each passage, grounding means electrically connected to the contacts for grounding the contacts to the shell, and circuit protection means electrically connected to each respective contact for preventing transmission of signals from the assembly which exceed a predetermined value.

The connector assembly is characterized by mounting means for releasably mounting the contacts in the shell. The mounting means includes a removable insert assembly having a like array of passages extending between its end faces and carrying a second contact in each passage thereof, means for aligning the inserts so that each array of passages is aligned with one another, and means for removably securing the insert assembly to a rearward end portion of the shell. The first contacts include mating forward and rearward end portions and a medial portion including a circuit protection element, the mating rearward end portion for completing an electrical interconnection with its respective second contact.

Advantageously such an electrical connector allows contacts to be provided with a silicon diode or varistor and be removed from the rearward end portion of the shell either for repair or for replacement another contact having different circuit protection.

The invention will now be described, by way of example, with reference to the following drawings in which.

Figure 1:
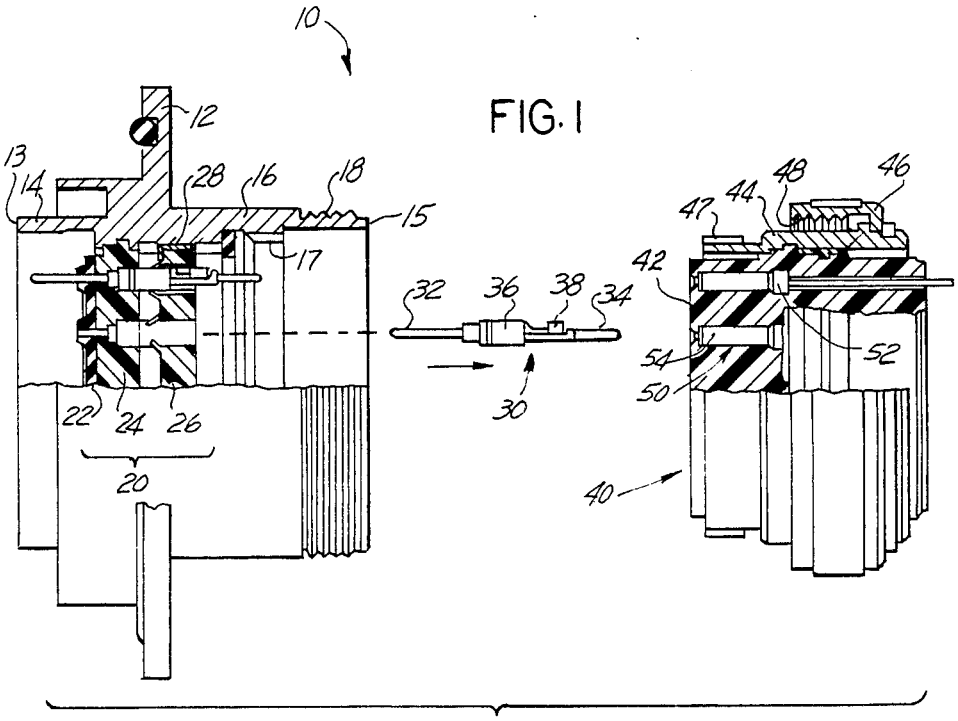
FIG. 1 is an exploded assembly elevation view in section showing an electrical connector.

Turning now to the drawing, FIG. 1 shows and electrical connector assembly 10 partially disassembled and including a hollow cylindrical metal shell 12 carrying an insert arrangement 20, a first contact 30, and a removable insert member 40. The shell 12 has a forward and rearward end portions 14, 16 each terminating in a respective end face 13, 15 with the forward end portion being for mating with another connector (not shown) and the rearward end portion having external thread 18.

The insert arrangement 20 includes an interfacial seal 22 of soft elastomerc material, a dielectric insert 24 of electrically insulative material, and a grounding plane 26, and a like array of passages extending through each and aligned so as to receive one of the first contacts. The grounding plane includes a bottle-cap shaped metal grounding spring 28 which receives a metallized wafer, the outer periphery of the spring making electrical contact with the inner wall of the shell (i.e., the connector ground) and the wafer having fingers disposed around each of its passages to engage the outer periphery of a first contact inserted therethrough.

The first contact 30 is axially elongated and includes a mating forward portion 32, a mating rearward end portion 34 and a medial portion 36 including its circuit protection element 38. As shown the mating end portions are formed into a pin for mating with a socket type contact. The outer periphery of the first contact is sized to clearance fit into one respective passage of the insert arrangement 40 and abut an end wall of the insert member 24 whereby to position the forward end portion 32 of the contact for further mating when the shell is mated.

The removable insert member 40 comprises a dielectric insert 42 having a like array of passages extending between its end faces, a cylindrical metal sleeve 44 secured to the outer periphery of the insert 42, and a coupling nut 46 rotatably mounted to the sleeve, the coupling nut having internal thread 48 to engage with the external thread 18 on the shell 12. The outer periphery of the sleeve 44 is adapted to clearance fit within the rearward end portion 16 of the shell.

A second contact 50 is secured in each respective passage of the insert member, the second contact having a front portion 54 formed into a socket for mating with the rearward end portion 34 of its associated first contact 30 and a rear portion 52 for further interconnection, such as by a crimp connection to an electrical wire.

To orient the removable insert member 40 relative to the shell whereby to align each respective array of contacts, a key 47 extends outwardly from the sleeve 44 to be received by a keyway 17 on the inner wall of the shell 12.

Figure 2:
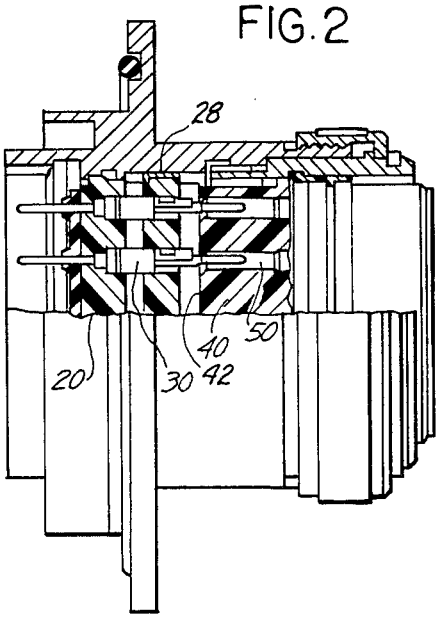
FIG. 2 is an elevation view in section of the assembled electrical connector.

FIG. 2 shows an assembled connector assembly. The first contacts 30 are disposed in their respective passages and positioned in the dielectric insert 24 with the pin-type rearward end portions 34 completing an electrical interconnection with the socket-type front portions 54. The grounding plane 26 completes an electrical contact with the first contacts 30 (and thus the circuit protect elements 38) and the shell.

Should repair or replacement of one of the first contacts be desired, the user uncouples the insert member 40 to expose the first contacts, selected of which may then be pulled outwardly and the circuit protection element may be repaired or replaced.

Having described the invention what is claimed is:

1. An electrical connector assembly for receiving and transmitting an electrical signal comprising a hollow cylindrical metal shell having a mating forward and a rearward end portion, a dielectric insert having an array of first passages extending therethrough, each first passage receiving an electrical first contact, said first contact comprising a mating forward and rearward end portion and a medial portion having circuit protection means electrically connected thereto for preventing transmission of signals from the assembly which exceed a predetermined value, grounding means electrically connected to each first contact for grounding the contacts to the shell, and mounting means for releasably mounting the first contacts in the shell, the mounting means comprising a removable insert assembly having a like array of second passages extending therethrough and carrying an electrical contact in each respective second passage thereof, each second contact being non-removably mounted in the insert assembly and having a forward end portion for mating with the rearward end portion of a first contact and a rearward end portion for further interconnection to transmit a protection signal, means for removably securing the insert assembly to the rearward end portion of the shell and means for aligning the dielectric insert and insert assembly so that the arrays of first and second passages are aligned with one another, said first contacts being individually removable from the rearward end portion of the shell upon removal of the insert assembly.

2. The electrical connector assembly as recited in claim 1 wherein a coupling nut is rotatably disposed on the outer periphery of the insert assembly, and further including engagement means for engaging the coupling nut with the rearward end portion of the shell.

3. The electrical connector assembly as recited in claim 1 wherein the means for aligning the inserts includes a key and a keyway, respectively, on one end and the other said insert assembly and shell.

4. The electrical connector assembly as recited in claim 1 wherein each second contact has a front portion comprising a socket, and each first contact has its rearward end portion formed into a pin for receipt in its associated socket.

5. The electrical connector assembly as recited in claim 4 wherein the forward end portion of each first contact comprises a pin.

* * * * *

US004789360B1

REEXAMINATION CERTIFICATE (2102nd)

United States Patent [19]

[11] B1 4,789,360

Paul et al.

[45] Certificate Issued Oct. 12, 1993

[54] ELECTRICAL CONNECTOR WITH REAR REMOVABLE CONTACTS

[75] Inventors: Richard L. Paul; Ronald W. Morse, both of Sidney, N.Y.

[73] Assignee: Bankers Trust Company, New York, N.Y.

Reexamination Request:
No. 90/002,894, Nov. 23, 1992

Reexamination Certificate for:

| | |
|---|---|
| Patent No.: | 4,789,360 |
| Issued: | Dec. 6, 1988 |
| Appl. No.: | 153,731 |
| Filed: | Jan. 19, 1988 |

[51] Int. Cl.[5] ..... H01R 13/66
[52] U.S. Cl. ..... 439/620

[56] References Cited

U.S. PATENT DOCUMENTS 4,126,370 11/1978 Nijman ..... 333/143 R
4,264,116 4/1981 Gliha ..... 339/89 M
4,600,262 7/1986 Nieman et al. ..... 339/147 R

FOREIGN PATENT DOCUMENTS 2279236 7/1974 France .

*Primary Examiner*—Joseph H. McGlynn

[57] ABSTRACT

A connector assembly allows rear repair/replacement of first contacts so that circuit protection elements may be checked for damage or replaced. A pair of inserts each having a like array of passages extending between its end faces are disposed in a connector shell one insert being fixed and adapted to receive the first contacts and the other insert being removable and carrying in its passages a second contact to mate with a first contact. The first contact carries the circuit protection element and is removably mounted in the shell with one end thereof for mating with a second contact. Means including a coupling nut removably secure the removable insert to a rearward end portion of the shell. Means including a key/keyway on the shell/removable insert align the inserts so that each array of passages is aligned with one another.

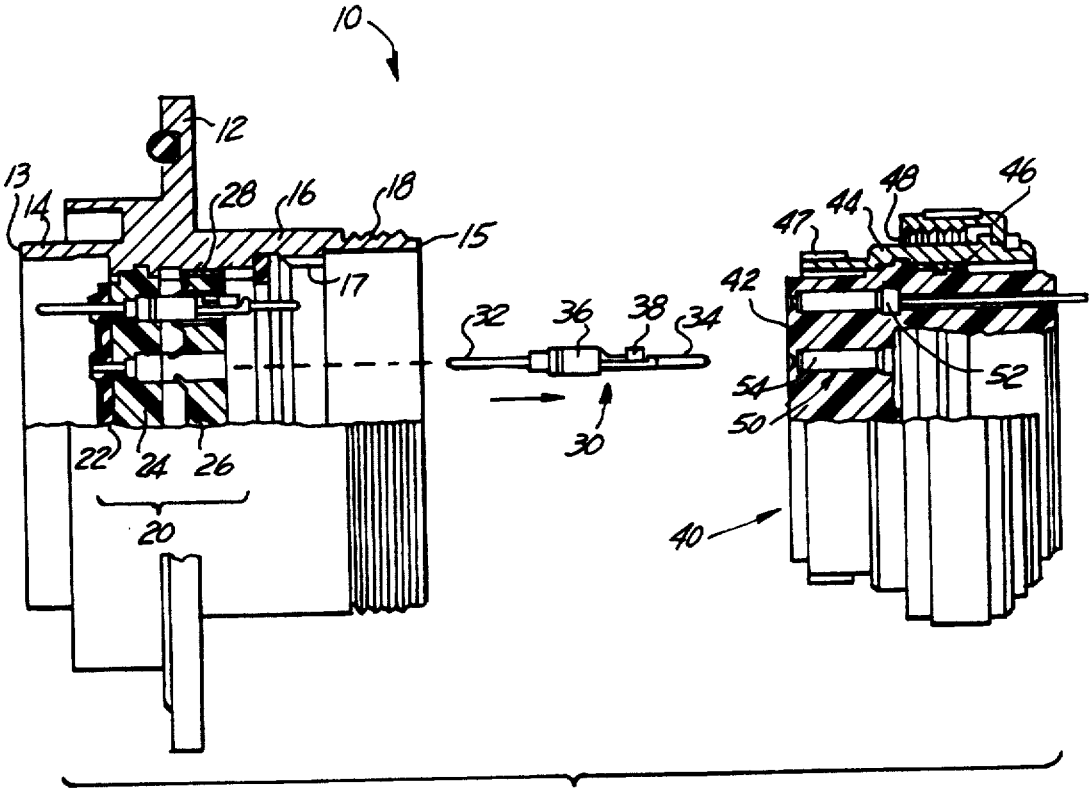

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-5 is confirmed.

* * * * *

US004789360B1

REEXAMINATION CERTIFICATE (2279th)

United States Patent [19]

Paul et al.

[11] B1 4,789,360

[45] Certificate Issued Apr. 26, 1994

[54] ELECTRICAL CONNECTOR WITH REAR REMOVABLE CONTACTS

[75] Inventors: Richard L. Paul; Ronald W. Morse, both of Sidney, N.Y.

[73] Assignee: Amphenol Corporation, Wallingford, Conn.

Reexamination Request:
No. 90/002,894, Nov. 23, 1992

Reexamination Certificate for:

| | |
|---|---|
| Patent No.: | 4,789,360 |
| Issued: | Jan. 19, 1988 |
| Appl. No.: | 153,731 |
| Filed: | Dec. 6, 1988 |

Related U.S. Application Data

[63] Continuation of Ser. No. 926,479, Nov. 3, 1986, abandoned.

[51] Int. Cl.[5] ..... H01R 13/66
[52] U.S. Cl. ..... 439/620

[56] References Cited

U.S. PATENT DOCUMENTS

| | | | |
|---|---|---|---|
| 4,126,370 | 11/1978 | Nijman | 333/143 R |
| 4,264,116 | 4/1981 | Gliha | 339/89 M |
| 4,600,262 | 7/1986 | Nieman et al. | 339/147 R |

FOREIGN PATENT DOCUMENTS 2279236 7/1974 France .

*Primary Examiner*—Joseph H. McGlynn

[57] ABSTRACT

A connector assembly allows rear repair/replacement of first contacts so that circuit protection elements may be checked for damage or replaced. A pair of inserts each having a like array of passages extending between its end faces are disposed in a connector shell one insert being fixed and adapted to receive the first contacts and the other insert being removable and carrying in its passages a second contact to mate with a first contact. The first contact carries the circuit protection element and is removably mounted in the shell with one end thereof for mating with a second contact. Means including a coupling nut removably secure the removable insert to a rearward end portion of the shell. Means including a key/keyway on the shell/removable insert align the inserts so that each array of passages is aligned with one another.

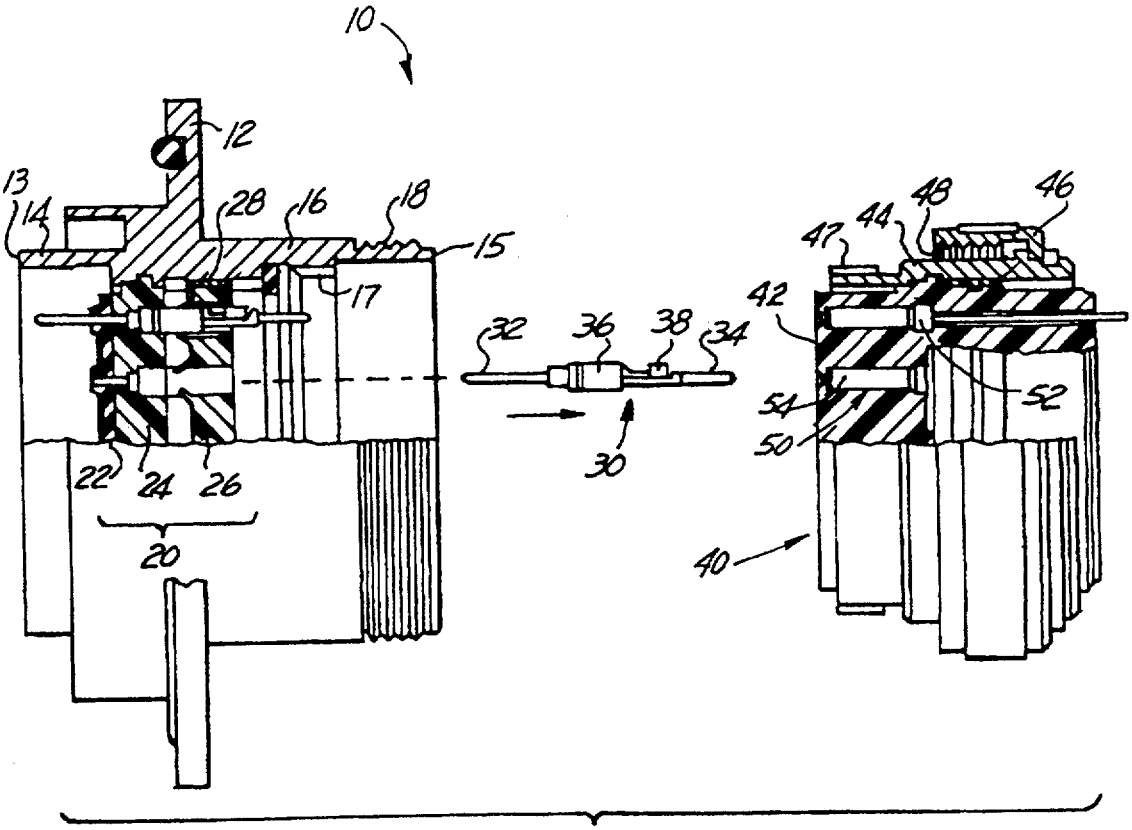

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2-5 dependent on an amended claim, are determined to be patentable.

1. An electrical connector assembly for receiving and transmitting an electrical signal comprising a hollow cylindrical metal shell having a mating forward and a rearward end portion, a dielectric insert having an array of first passages extending therethrough, each first passage receiving an electrical first contact, said first contact comprising a mating forward and rearward end portion and a medial portion having circuit protection means electrically connected thereto for preventing transmission of signals from the assembly which exceed a predetermined value, grounding means electrically connected to each first contact for grounding the contacts to the shell *through said circuit protection means*, and mounting means for releasably mounting the first contacts in the shell, the mounting means comprising a removable insert assembly having a like array of second passages extending therethrough and carrying an electrical contact in each respective second passage thereof, each second contact being nonremovably mounted in the insert assembly and having a forward end portion for mating with the rearward end portion of a first contact and a rearward end portion for further interconnection to transmit a [protection] *protected* signal, means for removably securing the insert assembly to the rearward end portion of the shell and means for aligning the dielectric insert and insert assembly so that the arrays of first and second passages are aligned with one another, said first contacts being individually removable from the rearward end portion of the shell upon removal of the insert assembly.

* * * * *